United States Patent [19]

Draxler et al.

[11] Patent Number: 4,539,452

[45] Date of Patent: Sep. 3, 1985

[54] SAFETY STOP SWITCH ASSEMBLY

[75] Inventors: James R. Draxler, Fond du Lac; Richard H. Snyder, Oshkosh, both of Wis.

[73] Assignee: Brunswick Corporation, Skokie, Ill.

[21] Appl. No.: 565,423

[22] Filed: Dec. 27, 1983

[51] Int. Cl.[3] ..... H01H 3/36

[52] U.S. Cl. ..... 200/334; 200/153 F; 200/161; 180/272; 440/84

[58] Field of Search ..... 200/161, 61.58 R, 153 F, 200/333, 334; 180/272; 440/84, 85

[56] References Cited

U.S. PATENT DOCUMENTS 2,722,575 11/1955 Dobkins ..... 200/52

3,786,892 1/1974 Horton ..... 440/85

4,250,358 2/1981 Gilbertson ..... 200/52

*Primary Examiner*—Stephen Marcus

*Assistant Examiner*—Renee S. Kidorf

*Attorney, Agent, or Firm*—O. T. Sessions

[57] ABSTRACT

A safety stop switch assembly (10) for controlling a device such as an outboard motor includes a toggle switch having a switch arm (12). A clip (16) is held in place around the switch arm (12) by a spring arm (21). The clip (16) can be attached to the operator by a lanyard (17). When the operator is sufficiently removed from the device, the lanyard (17) will pull the clip (16) away from the switch arm (12) and turn the switch off. The switch arm (12) can be used to control the outboard motor with or without the use of the clip (16).

8 Claims, 2 Drawing Figures

SAFETY STOP SWITCH ASSEMBLY

DESCRIPTION

1. Technical Field

The present invention relates to a safety stop switch for turning off an electrically operated device in the event the operator is separated from the switch.

2. Background Art

A safety stop switch for a marine engine disclosed in U.S. Pat. No. 4,250,358 to Gilbertson. That safety stop switch uses a clip which fits over the arm of a toggle switch. A hood covering the toggle switch arm when the switch is in the on position prevents removal of the clip without turning the switch to the off position. A lanyard is attached to the clip and to the operator so as to turn off the switch when the operator moves sufficiently away from the switch, as determined by the lanyard length. Though the switch functions adequately as a safety stop switch, other use of the switch is prevented since turning the switch off will allow the clip to separate from the toggle switch and since the hood limits access to the toggle switch arm.

DISCLOSURE OF INVENTION

One of the objects of the present invention is to provide a safety stop switch which may also be used as an on-off switch.

The objects of the present invention are accomplished by a safety stop switch assembly which includes a base having a hole therethrough and a switch attached to the base for controlling an electrically operated device. The switch includes a snap action actuator arm for operating the switch between an on and off position. The actuator arm extends through the hole in the base and has a pivot axis below the surface of the base. A clip is provided which encircles the actuator arm and has a lanyard for attachment to the operator. An attachment means is provided to releasably attach the clip to the base and hold the clip in position encircling the actuator arm. The catch means holds the clip adjacent to the actuator arm to prevent removal of the clip without moving the actuator arm to the off position.

Preferably the attachment means includes a spring arm attached to the base and biased against the clip. In the preferred embodiment the spring arm is cantilevered and has a free end adjacent the actuator arm when the actuator arm is in the on position. A projection is provided at the end of the cantilevered arm to retain the clip in place. A pair of guides on opposite sides of the spring arm limit the motion of the clip as the clip is removed from the position encircling the actuator arm to assure that the clip can be removed only in a direction to actuate the switch.

BEST MODE FOR CARRYING OUT THE INVENTION

Figure 1:
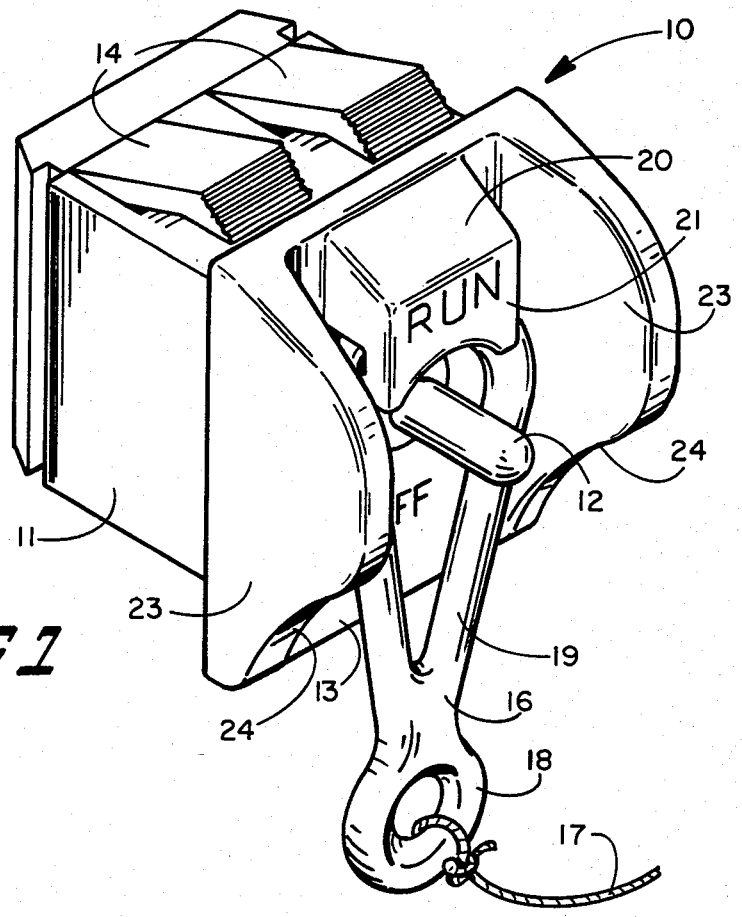
FIG. 1 is a perspective view of a safety stop switch according to the invention.

Referring to the drawings, a safety stop switch assembly 10 suitable for mounting on the cowl of an outboard motor is illustrated. The safety stop switch assembly 10 includes a toggle switch having its body 11 supported behind the surface of the cowl and a switch arm 12 extending in front of the surface of the cowl. A mounting base 13 is attached to the body 11 of the switch for supporting the switch body 11 against the external surface of the cowl. Spring arms 14, formed on the switch body 11, deflect to allow the body 11 of the switch to be pushed through a hole in the cowl and expand to hold the safety switch assembly 10 in place on the cowl.

Figure 2:
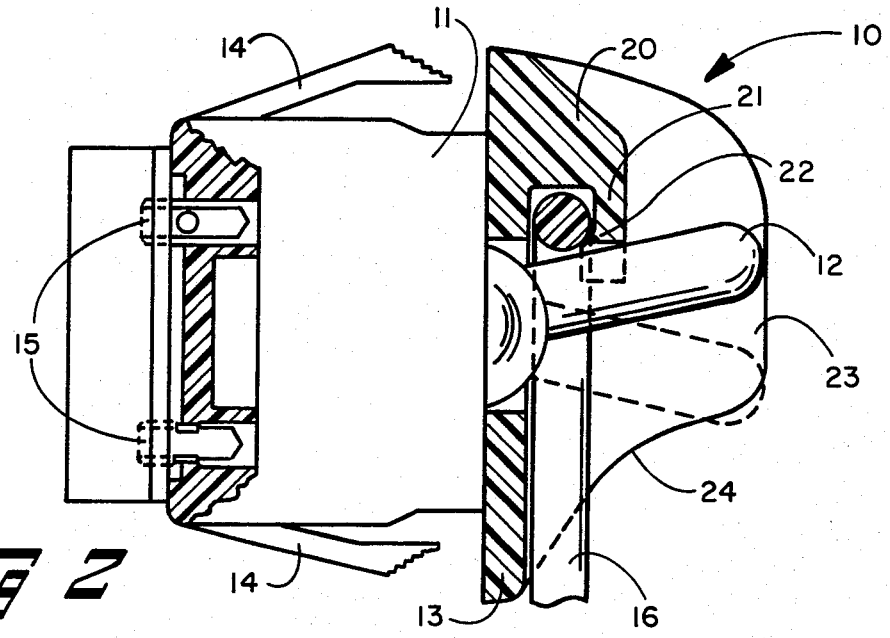
FIG. 2 is a view partially in section of the safety stop switch assembly shown in FIG. 1.

The toggle switch is a two position switch having an off position, shown in broken lines in FIG. 2, and a running position. Two contacts 15 allow the switch to be connected to the ignition circuit of the engine to interrupt the operation of the outboard motor engine when the switch is in the off position. In the run position the outboard motor can be controlled in its normal fashion.

A clip 16 is provided to connect the switch arm 12 to an operator by means of a lanyard 17. A small loop 18 is formed on on the end of the clip 16 for the attachment of the lanyard. A larger loop 19 at the other end of the clip 16 encircles the switch arm 12.

A catch 20 is formed on the exterior of the mounting base 13 to attach the clip 16 in position. The catch 20 includes a spring arm 21 cantilevered toward the switch arm 12. A projection 22 near the free end of the spring arm 21 serves to retain the clip 16 in position encircling the switch arm 12 regardless of the position of the switch arm 12. The arcuate free end of the spring arm 21 is positioned immediately adjacent the switch arm 12 when the switch arm 12 is in the running position to assure that removal of the clip 16 will move the toggle switch arm over center and thus to the off position.

A pair of guides 23 are formed on the base 13 on opposite sides of the spring arm 21. The guides 23 have arcuate ramps 24 formed on their ends remote from the spring arm 21. The ramps 24 guide the clip 16 when the clip 16 is pulled by the lanyard 17 in lateral directions, to move the end of the clip 16 outward away from the cowl, thus preventing a direct lateral force from being applied to the switch arm 12. The guides 23 thus allow the clip 16 to be moved only in directions that would turn the switch off if the switch were in the running position. The guides 23 also serve to protect the switch arm 12 from damage.

In the preferred embodiment the mounting base 13, switch housing 11, catch 20, and guides 23 are all formed as a unitary piece which can be injection molded of a polymer such as nylon.

OPERATION

In operation the operator of the outboard motor attaches the clip 16 to himself by means of the lanyard 17. With the switch in the off position the clip 16 can then be snapped into place under the spring arm 21. With the clip 16 in place the switch can be turned to the run position and the outboard motor can then be operated as desired. The spring arm 21 holds the clip 16 and lanyard 17 in position for immediate use, yet allows the switch to be used as a simple on-off switch.

Should the operator accidently or otherwise become separated from the outboard motor, as for example by falling out of the boat, the lanyard 17 will pull the clip 16 away from the switch 10 and turn the toggle switch to the off position thereby stopping the outboard motor. A second boat operator can then easily turn the switch 10 to the run position and operate the boat and motor to rescue the original operator, without the necessity for an additional clip 16 or any difficult manipulations.

Because the toggle switch arm 12 projects through the clip 16 and beyond the spring arm 21, the switch can be used as an engine kill switch whether the clip 16 is in use or not. The invention thus provides a lanyard actuated stop switch with a manual override capability which is convenient and reliable to use and can be economically produced.

We claim:

1. A safety stop switch assembly comprising:

(A) a base having a hole therethrough;

(B) a switch attached to said base for controlling an electrically operated device, said switch including an actuator arm for operating said switch between an on and on off position, said actuator arm extending through said hole and having a pivot axis below the surface of said base;

(C) a clip encircling said actuator arm; and (D) an attachment means for releasably attaching said clip to said base and holding said clip in position encircling said actuator arm regardless of the position of said actuator arm and permitting operation of said actuator irrespective of the presence of said clip, said attachment means holding said clip adjacent said actuator arm to prevent removal of said clip without moving said actuator arm to the off position.

2. The safety stop switch assembly defined in claim 1 wherein said attachment means is attached to said base.

3. The safety stop switch assembly defined in claim 2 wherein said catch means includes a spring arm attached to said base and biased against said clip.

4. The safety stop switch assembly defined in claim 3 wherein said spring arm is cantilevered and has a free end adjacent said actuator arm when said actuator arm is in the on position.

5. The safety stop switch assembly defined in claim 4 wherein said clip is pushed by said spring arm against said base.

6. The safety stop switch defined in claim 5 wherein said spring arm includes a projection near said free end, said projection facing said base.

7. The safety stop switch defined in claim 6 wherein said clip includes a first loop encircling said actuator arm and a second loop for attaching a lanyard to said clip.

8. The safety stop switch defined in claim 7 further comprising a pair of guides on opposite sides of said spring arm to limit the motion of said clip as said clip is removed from the position encircling said actuator arm.

* * * * *